US005850756A

United States Patent [19]

Chang

[11] Patent Number: 5,850,756

[45] Date of Patent: Dec. 22, 1998

[54] WORKPIECE EJECTING MECHANISM FOR A FORGING APPARATUS

[75] Inventor: Yun-Te Chang, Tainan, Taiwan

[73] Assignee: FWU Kuang Enterprises Co., Ltd., Tainan Hsien, Taiwan

[21] Appl. No.: 904,823

[22] Filed: Aug. 1, 1997

[51] Int. Cl.[6] ..... B21D 45/00

[52] U.S. Cl. ..... 72/344

[58] Field of Search ..... 72/344, 345, 346, 72/134, 328, 361, 427, 419, 432, 463

[56] References Cited

U.S. PATENT DOCUMENTS

| | | | |
|---|---|---|---|
| 3,771,344 | 11/1973 | Wright | 72/345 |
| 3,939,685 | 2/1976 | Hortig | 72/361 |
| 4,796,460 | 1/1989 | Smedberg et al. | 72/344 |

*Primary Examiner*—Joseph J. Hail, III
*Assistant Examiner*—Rodney Butler
*Attorney, Agent, or Firm*—Skjerven, Morrill, MacPherson, Franklin & Friel LLP; Alan H. MacPherson

[57] ABSTRACT

A workpiece ejecting mechanism for a forging apparatus includes a rod passage formed in a machine bed, and a workpiece pushing rod and a driving rod which are received slidably in the rod passage. An air passage is formed in the machine bed and is communicated fluidly with the rod passage so as to fill the rod passage with compressed air via the air passage, thereby biasing the pushing rod to move away from the driving rod until a front shoulder of the pushing rod contacts a front blocking unit, and thereby biasing the driving rod to move away from the pushing rod until a rear shoulder of the driving rod contacts a rear blocking unit.

3 Claims, 6 Drawing Sheets

WORKPIECE EJECTING MECHANISM FOR A FORGING APPARATUS

BACKGROUND OF THE INVENTION

1. Field of the Invention

This invention relates to a workpiece ejecting mechanism for a forging apparatus, more particularly to a workpiece ejecting mechanism which can retain effectively a workpiece on a forging die set when the workpiece is moved into the forging die set and which can diminish noise caused by rearward movement of a driving rod.

2. Description of the Related Art

Referring to FIG. 1, a conventional screwhead forming apparatus 1 is shown to include a workpiece feeding mechanism 11 disposed on a machine bed 10, a blocking mechanism 12, and a cutting mechanism 13. When an elongated blank 2 is held on a chuck 130 and engages the blocking mechanism 12, a cutting member 131 cuts the blank 2 to form a blank section 20 of a predetermined length which is moved by a push pin 14 away from the cutting member 13. Then, the blank section 20 is sent to a forging die mechanism 15 which includes fixed tubular die members 150, 151, 152 and punch-moved die members 153, 154, 155. The die members 153, 154, 155 are driven by a flywheel (not shown) and a crank (not shown) to reciprocate relative to the die members 150, 151, 152. In the die mechanism 15, the blank section 20 (see FIG. 2A) projects from the tubular die member 150 and is forged by means of the punch-moved die member 153 to form a first semi-finished product 21 (see FIG. 2B) which is further forged by means of the die members 151, 154 to form a second semi-finished product 22 (see FIG. 2C) that is further dealt with by means of the die members 152, 155 to form a final product 23 (see FIG. 2D).

As illustrated, to remove a workpiece, such as product 21, 22 and 23, from the corresponding die member 150, 151, 152, a workpiece pushing rod 156 is provided to push the workpiece out from the die member 150, 151, 152 by engaging a front end (a) of the pushing rod 156 with a rear end (c) of the workpiece.

The workpieces 20, 21, 22 are sufficiently long to permit insertion into the die members 150, 151, 152 by means of a holding mechanism (not shown). However, referring to FIGS. 1, 3A, 3B, 3C and 3D, when a shorter workpiece 70 is to be forged to form a first finished-product 71, a second finished-product 72, and a final product 73 by means of the apparatus 1 (see FIG. 1), it is difficult to insert the workpiece 70, 71, 72 into the die members 150, 151, 152. To solve this problem, a bushing (b) is sleeved on each of the pushing rods 156 and has a frictional inner surface which engages frictionally the rod 156 so that the holding mechanism (not shown) can move a workpiece to a position in which the workpiece is clamped between the die member 153, 154, 155 and the front end (a) of the pushing rod 156. However, the frictional inner surface of the bushing (b) can be easily worn and cannot hold effectively the rod 156. Furthermore, when the pushing rod 156 moves rearward to strike on a driving rod 157, a relatively loud sound is created.

SUMMARY OF THE INVENTION

An object of this invention is to provide a workpiece ejecting mechanism for a forging apparatus which can retain effectively a workpiece on a forging die set when the workpiece is moved into the forging die set and which can diminish noise caused by rearward movement of a driving rod.

According to this invention, a workpiece ejecting mechanism for a forging apparatus is provided. The apparatus includes a machine bed formed with a rod passage, an operating mechanism mounted operatively on the machine bed, a female die mechanism fixed on the machine bed, a male die mechanism driven by the operating mechanism to press against the female die mechanism and adapted to clamp a workpiece between the male die mechanism and the female die mechanism, a swing arm mechanism activating the ejecting mechanism to move in the rod passage, a front blocking unit provided in the female die mechanism, and a rear blocking unit provided in the machine bed near the swing arm mechanism. The rod passage is located between the female die mechanism and the swing arm mechanism. The ejecting mechanism includes a workpiece pushing rod which is mounted movably within the rod passage of the machine bed and which has a rear end and a front end that is adapted to engage and push the workpiece out of the female die mechanism, and a driving rod which is mounted movably in the rod passage and which has a rear end that can be engaged and impelled by the swing arm mechanism to move in the rod passage, and a front end that can be moved forward to engage the rear end of the pushing rod so as to move the pushing rod forward. The pushing rod has a front shoulder which can be moved forward to abut against the front blocking unit so as to prevent further forward movement of the pushing rod in the machine bed. The driving rod has a rear shoulder which can be moved rearward to abut against the rear blocking unit so as to prevent further rearward movement of the driving rod in the machine bed. An air passage is formed in the machine bed and is communicated fluidly with a portion of the rod passage which is located between the front shoulder of the pushing rod and the rear shoulder of the driving rod and which is adapted to be filled with compressed air via the air passage so as to bias the pushing rod forward to press against the workpiece and so as to bias the driving rod rearward to press against the swing arm mechanism.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
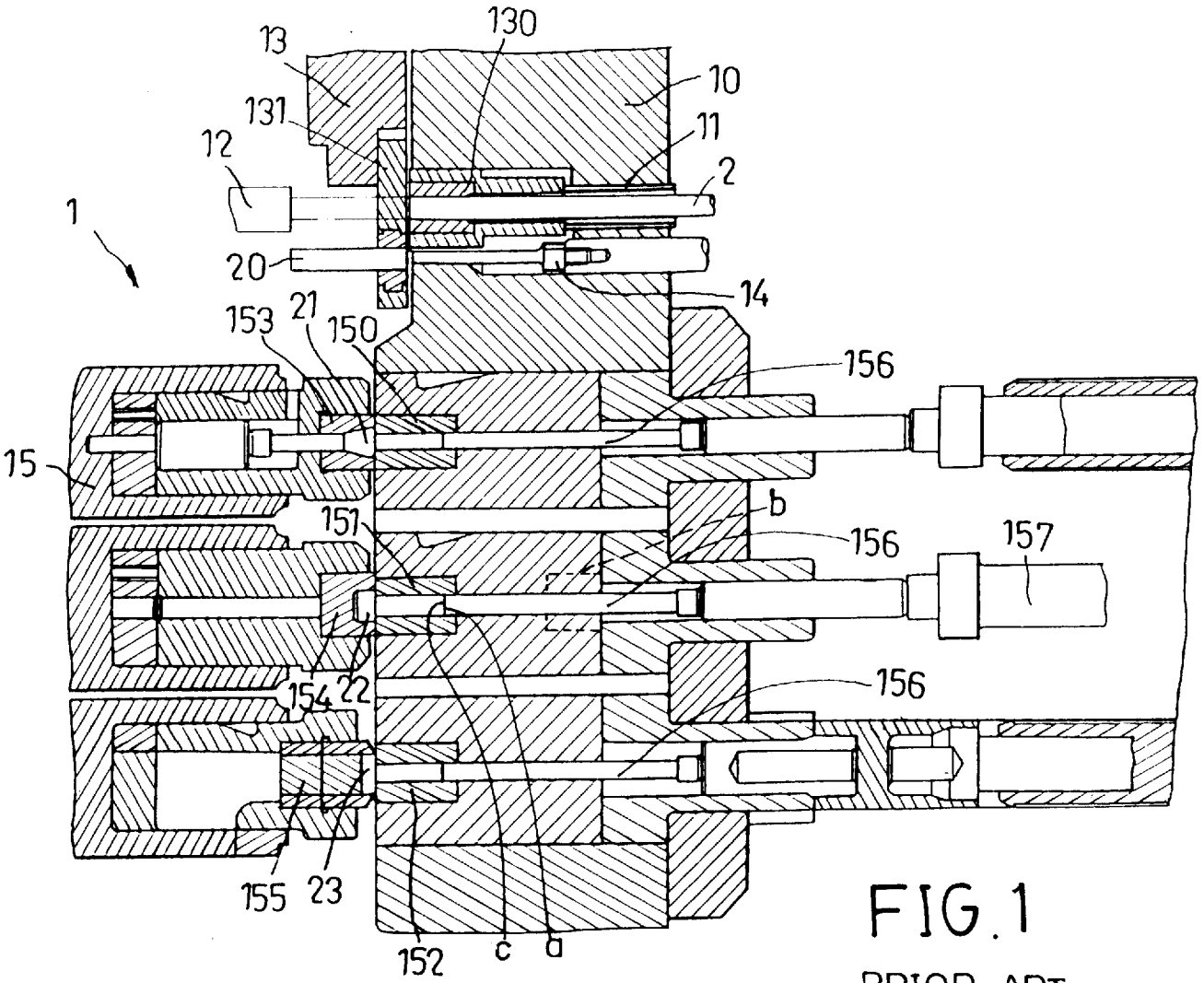
FIG. 1 PRIOR ART
FIG. 1 illustrates a conventional workpiece ejecting mechanism for a forging apparatus.
Figure 2A:
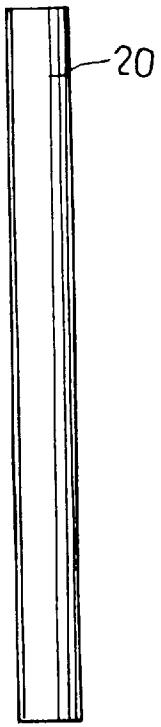
FIG. 2A PRIOR ART
FIGS. 2A, 2B, 2C and 2D illustrate how a long bolt is formed by the forging apparatus of FIG. 1.
Figure 2B:
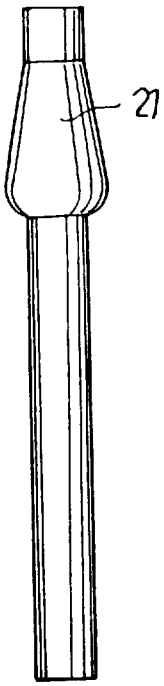
FIG. 2B PRIOR ART
Figure 2C:
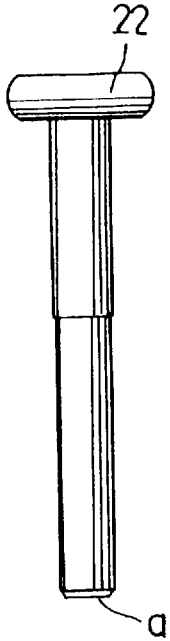
FIG. 2C PRIOR ART
Figure 2D:
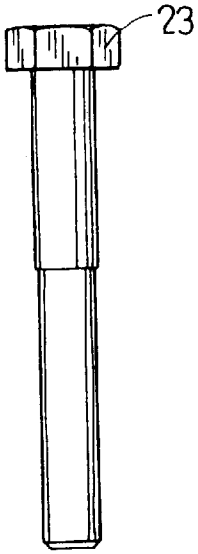
FIG. 2D PRIOR ART
Figure 3A:
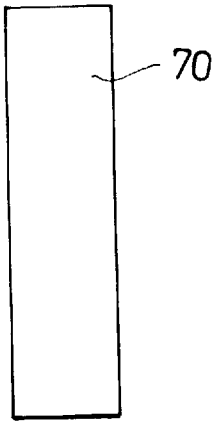
FIG. 3A PRIOR ART
FIGS. 3A, 3B, 3C and 3D illustrate how a short bolt is formed by the forging apparatus of FIG. 1.
Figure 3B:
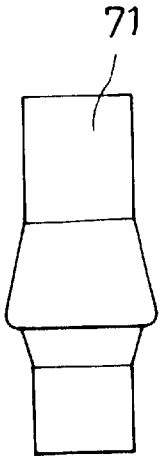
FIG. 3B PRIOR ART
Figure 3C:
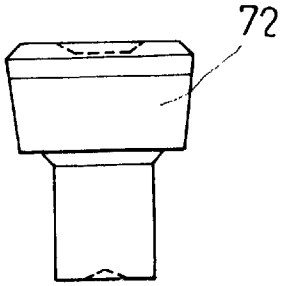
FIG. 3C PRIOR ART
Figure 3D:
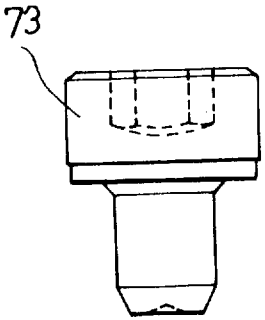
FIG. 3D PRIOR ART
Figure 4:
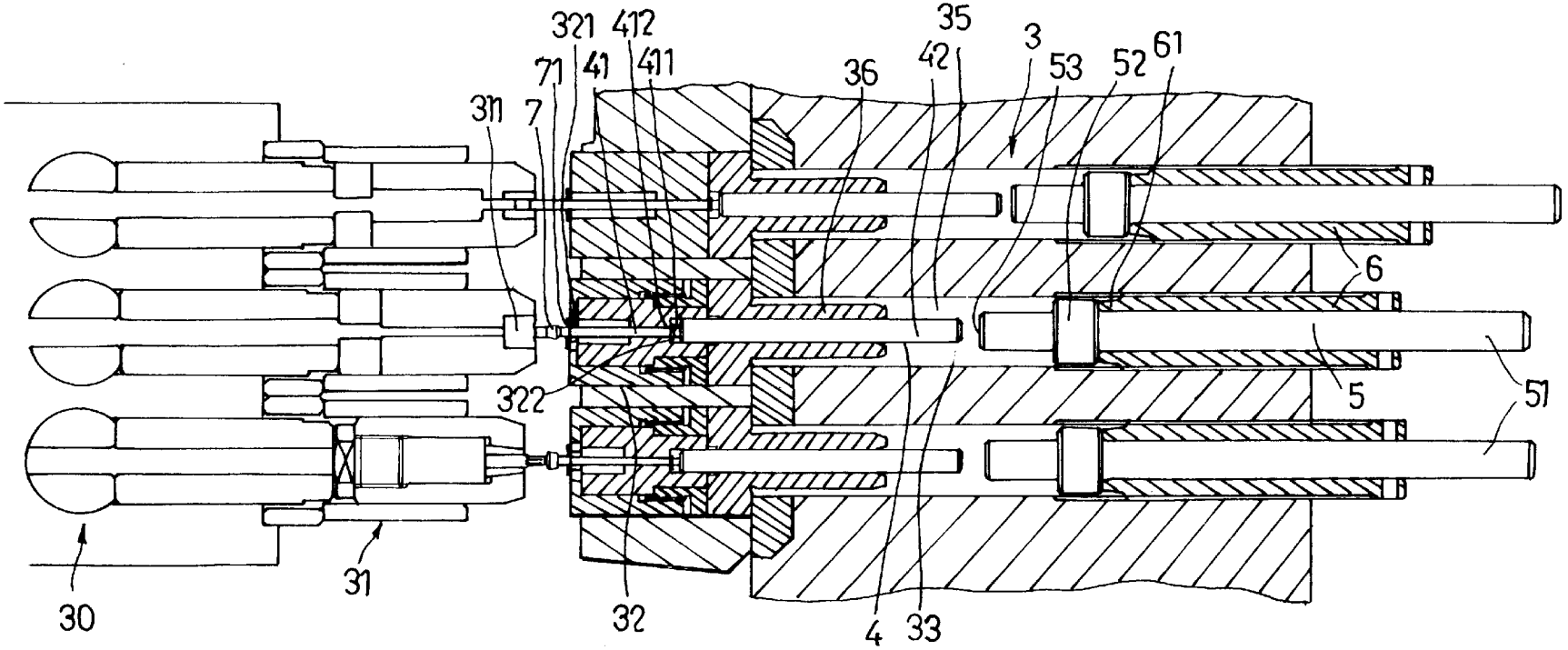
FIG. 4 is a schematic view of a workpiece ejecting mechanism for a forging apparatus according to this invention, illustrating how a workpiece is moved into and retained effectively on a forging die set.
Figure 5:
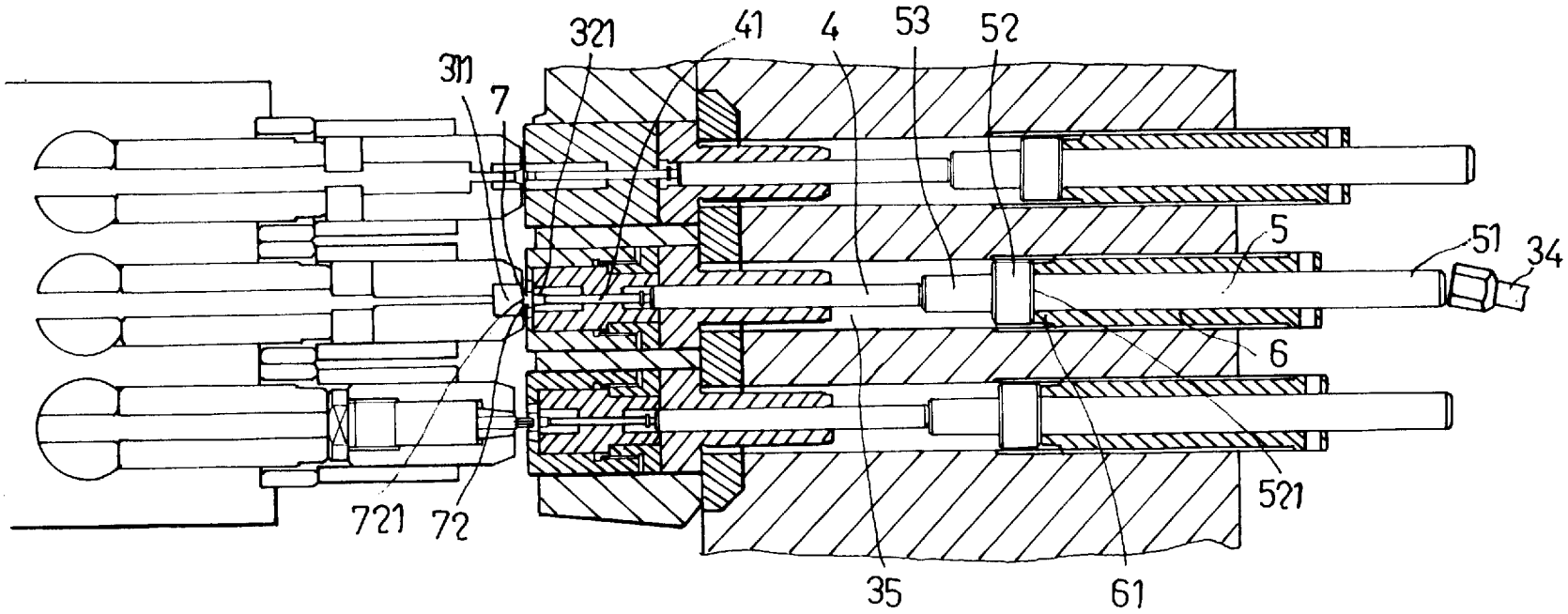
FIGS. 5 and 6 are schematic top and side views of the workpiece ejecting mechanism of this invention, illustrating how the workpiece is forged in the forging die set.
Figure 6:
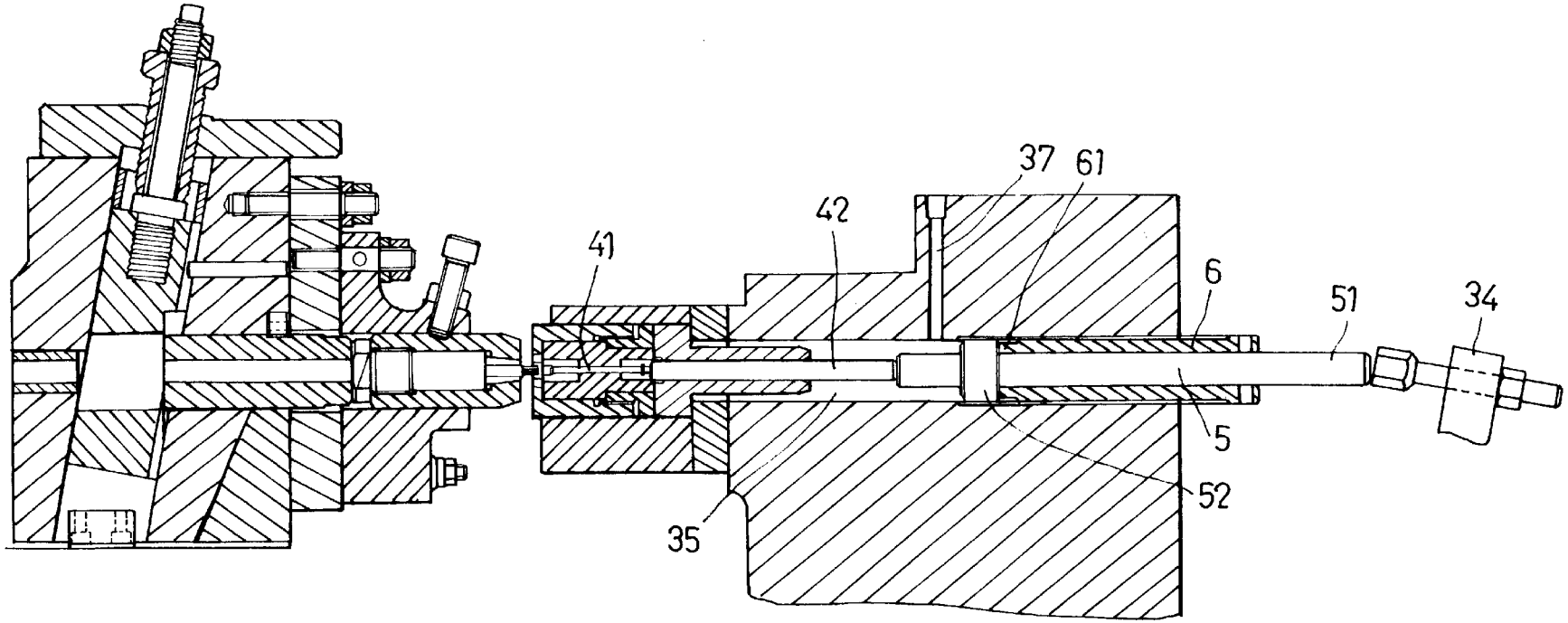

FIGS. 4, 5 and 6 show a preferred embodiment of a workpiece ejecting mechanism 33 for a forging apparatus of this invention. The apparatus has a machine bed 3 which is formed with three parallel rod passages 35 and which is equipped with three forging units, each including an operating mechanism 30 mounted operatively on the machine bed 3, a female die mechanism 32 fixed on the machine bed 3, a male die mechanism 31 driven by the operating mechanism 30 to press against the female die mechanism 32 and adapted to clamp a workpiece 7 between the male die mechanism 31 and the female die mechanism 32, and a swing arm mechanism 34 activating the ejecting mechanism 33 to move in the rod passage 35. The rod passages 35 are located between the female die mechanism 32 and the swing arm mechanism 34.

In each of the forging units, the female die mechanism 32 has a workpiece inlet 321 and a front blocking unit 322 which is constituted by a shoulder that is defined between two hole sections of different diameters, and a front end portion of a tubular adjustment bolt 6 constitutes a rear blocking unit 61 in the machine bed 3 near the swing arm mechanism 34.

Each of the ejecting mechanisms 33 includes a workpiece pushing rod 4 which is mounted movably within the rod passage 35 and which has a rear end and a front end that is adapted to engage and push the workpiece 7 out of the female die mechanism 32, and a driving rod 5 which is mounted movably in the rod passage 35 and which has a rear end engaging and being impelled by the swing arm mechanism 34 to move in the rod passage 35, and a front end that can be moved forward to engage the rear end of the pushing rod 4 so as to move the pushing rod 4 forward. Each of the pushing rods 4 extends through a tubular guide 36 fixed in the rod passage 35 and has a thin front section 41 and a thick rear section 42 which is connected securely to the front section 41. Each of the front sections 41 has a front shoulder 412 which is defined by a front end surface of an outwardly extending flange 411 of the pushing rod 4 and which can be moved forward to abut against the front blocking unit 322 so as to prevent further forward movement of the pushing rod 4 in the bed 3.

Each of the driving rods 5 has a rear end engaging the swing arm mechanism 34, an outwardly extending flange 52 with a rear end surface defining a rear shoulder 521 which can be moved rearward to abut against the rear blocking unit 61 so as to prevent further rearward movement of the driving rod 5 in the machine bed 3, and a front end portion 53 which can be moved forward to engage the pushing rod 4.

In each of the forging units, an air passage 37 (see FIG. 6) is formed in the machine bed 3 and is communicated fluidly with a portion of the rod passage 35 which is located between the front shoulder 412 of the pushing rod 4 and the rear shoulder 521 of the driving rod 5 to fill the rod passage 35 with compressed air from a compressed air source (not shown) via the air passage 37 so as to be adapted to bias the pushing rod 4 forward to press against the workpiece 7 and so as to bias the driving rod 5 rearward to press against the swing arm mechanism 34. Because the compressed air in the rod passages 35 presses the front shoulders 412 of the pushing rods 4 against the front blocking units 322 so as to locate the front ends of the pushing rods 4 at or near the workpiece inlets 321 of the female die mechanisms 32, when the workpieces 7 are moved by holding mechanisms 71 into the spaces between the male die mechanisms 31 and the female die mechanisms 32, the front ends of the pushing rods 4 move to the positions shown in FIG. 4 in which each of the pushing rods 4 presses the workpiece 7 against a forging die 311 of the male die mechanism 31 so as to prevent removal of the workpieces 7 from the male die mechanisms 31, thereby retaining effectively the workpieces 7 on the forging die sets consisting of the male and female die mechanisms 31, 32. Each of the workpieces 7 has an end surface formed with a tapered recess 721 into which the front end of the pushing rod 4 can extend so as to hold the workpiece 7 firmly on the male die mechanism 31.

To forge the workpieces 7 in the forging units, the male die mechanisms 31 are moved to the positions shown in FIGS. 5 and 6 in which the male die mechanisms 31 press against the female die mechanisms 32. After the die forging of the workpieces 7 has been finished, the swing arm mechanisms 34 move the pushing rods 4 back to the positions shown in FIG. 4 so as to push the workpieces 7 out of the female die mechanisms 32. Then, the swing arm mechanisms 34 swing rearward. The compressed air in the rod passages 35 pushes the driving rods 5 rearward to engage and follow the swing arm mechanisms 34 which are swinging rearward. Accordingly, the speed of rearward movement of the driving rods 5 is relatively slow so that noise caused by the engagement of the driving rods 5 with the rear blocking unit 61 is diminished.

With this invention thus explained, it is apparent that numerous modifications and variations can be made without departing from the scope and spirit of this invention. It is therefore intended that this invention be limited only as indicated in the appended claims.

I claim:

1. A forging apparatus, comprising:

a machine bed;

a rod passage formed in said machine bed;

an operating mechanism mounted operatively on said machine bed;

a female die mechanism fixed on said machine bed;

a male die mechanism driven by said operating mechanism to press against said female die mechanism for clamping and forging a workpiece located between said male die mechanism and said female die mechanism;

a workpiece pushing rod which is mounted movably within said rod passage having a rear end and a front end said front end being disposed adjacent the female die mechanism;

a driving rod which is movably mounted in said rod passage and having a rear end and a front end, said front end being disposed towards the rear end of the workpiece pushing rod;

a swing arm mechanism disposed adjacent the rear end of the driving rod, said swing arm mechanism providing a forward thrust to a rear end of the driving rod so as to impel the front end of the driving rod to engage the rear end of the workpiece pushing rod and move the workpiece pushing rod forward, thereby pushing a workpiece out of the female die mechanism; and an air passage formed in said machine bed and communicated fluidly with a portion of said rod passage which is located between said workpiece pushing rod and said driving rod, whereby compressed air provided through said air passage biases the workpiece pushing rod forward to press against the workpiece and biases the driving rod rearward to press against the swing arm mechanism.

2. The forging apparatus of claim 1, wherein:

said female die mechanism further comprises a front blocking unit; and said workpiece pushing rod further comprises a front shoulder which abuts against said front blocking unit to prevent further forward movement of said workpiece pushing rod when said workpiece pushing rod is moved in a forward direction in said rod passage to push the workpiece out of said female die mechanism.

3. The forging apparatus of claim 1, wherein:

said machine bed further comprises a rear blocking unit; and said driving rod further comprises a rear shoulder which abuts against said rear blocking unit to prevent further rearward movement of said driving rod when said driving rod is moved in a rearward direction in said rod passage.

* * * * *